United States Patent [19]
Fischer
[11] 4,194,337
[45] Mar. 25, 1980

[54] MOUNTING ELEMENT

[76] Inventor: Artur Fischer, Weinhalde 34, D-7244 Waldachtal 3 (Tumlingen), Fed. Rep. of Germany

[21] Appl. No.: 958,990

[22] Filed: Nov. 8, 1978

[30] Foreign Application Priority Data

Nov. 22, 1977 [DE] Fed. Rep. of Germany ..... 2752032

[51] Int. Cl.[2] ..... E04B 1/38
[52] U.S. Cl. ..... 52/713; 52/428
[58] Field of Search ..... 52/378, 379, 428, 568, 52/509, 712–714

[56] References Cited

U.S. PATENT DOCUMENTS

| | | | |
|---|---|---|---|
| 1,713,516 | 5/1929 | Beeker | 52/713 X |
| 1,946,732 | 2/1934 | Danielson | 52/428 |
| 3,292,336 | 12/1966 | Brynjolfsson | 52/713 |
| 3,729,882 | 5/1973 | Allen | 52/713 X |

*Primary Examiner*—J. Karl Bell
*Attorney, Agent, or Firm*—MichaelJ. Striker

[57] ABSTRACT

A mounting element is provided for connecting a cladding structure to a support wall with the use of a wire anchoring member having one end mortared in the cladding structure. The mounting element has a plate-like holding portion adapted to be driven into the support wall, and an eye-like receiving portion adapted to receive the other end of the wire anchoring member. The mounting element may be manufactured from a thin sheet whose one part forms the holding portion, and another part is bent so as to form a sleeve-shaped receiving portion located centrally and extending lengthwise of the holding portion. An end face of the receiving portion may be offset relative to an end edge of the holding portion by a distance which is substantially equal to the thickness of the wire anchoring element. A leading end section of the holding portion may be bevelled so as to form an insertion tip.

11 Claims, 2 Drawing Figures

FIG. 1
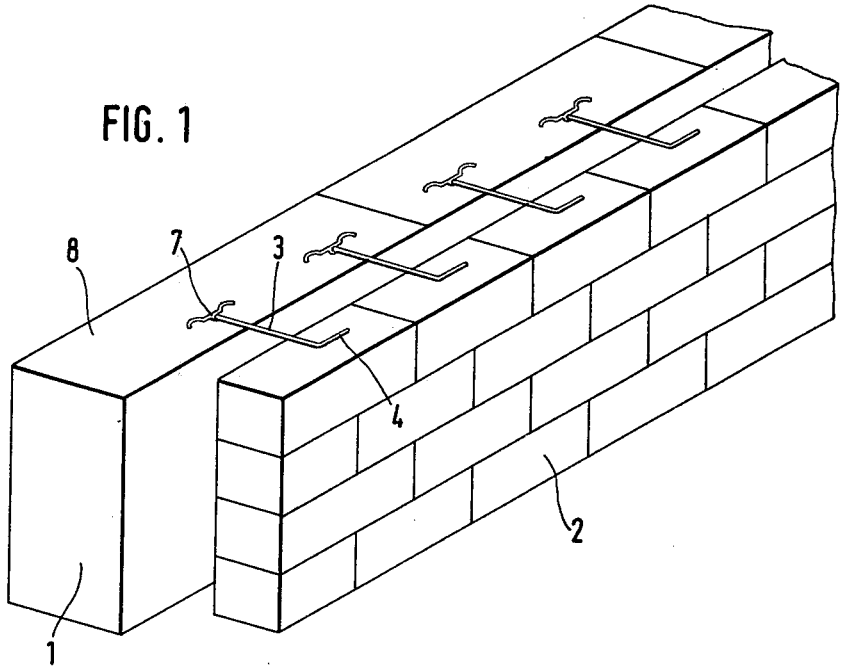
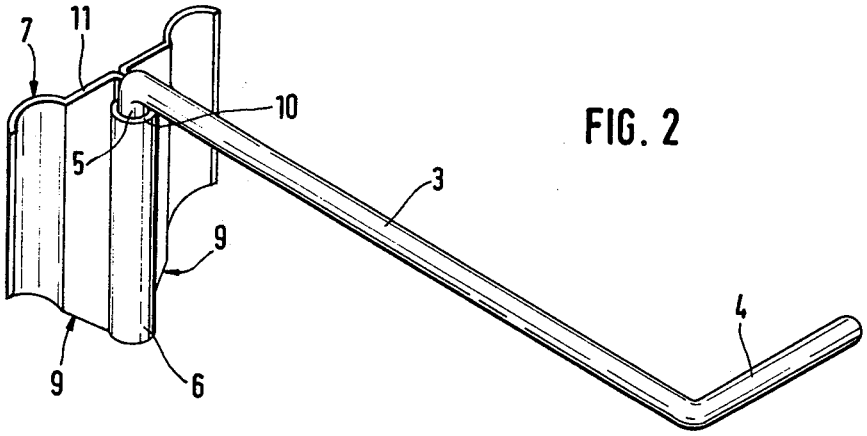
FIG. 2

MOUNTING ELEMENT

BACKGROUND OF THE INVENTION

The present invention relates to a mounting element for and a method of connecting a ventilated cladding structure to a support wall, with the use of a wire anchoring member.

It is known to connect a ventilated clading structure to a support wall, particularly one composed of aerated cement blocks, by wire anchoring members whose one ends are mortared in joints of the cladding structure. In order to take up the load which acts upon a cladding structure, it has been proposed to utilize S-shaped wire anchoring members and to mortar their other ends in joints of the support structure, or to drive these ends into the support structure when the latter is composed of soft and porous blocks, such as aerated cement blocks. However, the holding force which is attained by anchoring of the ends of the wire anchoring members in the aerated cement blocks is small, whereby in order to take up the load a great number of the wire anchoring members per area unit must be provided.

SUMMARY OF THE INVENTION

Accordingly, it is an object of the present invention to provide a mounting element for and a method of connecting ventilated cladding structure to a support wall with the use of a wire anchoring member, which avoid the disadvantages of the prior art.

More particularly, it is an object of the present invention to provide a mounting element for and a method of connecting a ventilated cladding structure to a support wall, which provide for taking up considerably higher loads, particularly when the support structure is composed of aerated cement blocks, than known elements and methods.

In keeping with these objects and with others which will become apparent hereinafter, one feature of the present invention resides, briefly stated, in a mounting element which has a plate-like holding portion arranged to be driven into a joint-forming outer face of the support structure, and an eye-like receiving portion arranged to receive the other end of a wire anchoring member, whereas one end of the latter is mortared in a joint of a cladding structure.

The plate-like holding portion is so driven into the support wall that it is parallel to an outer surface of the latter. As a result of this location and the plate-like construction of the holding portion, the latter can take up very high compression and tension loads, even when the holding portion is inserted into a porous and low strength support wall, such as an aerated cement wall. Since the other end of the wire anchoring elements is received or hooked in the eye-like receiving portion, a force acting upon the cladding structure is directly transmitted to the holding portion which is driven in the support wall.

In accordance with another feature of the present invention, a method of mounting a cladding structure to a support wall with the use of a wire anchoring member is provided, which method includes the steps of driving a plate-like holding portion of a mounting element into the support wall, mortaring one end of the wire anchoring member in a joint of the cladding structure, and hooking the other end of the wire anchoring member into an eye-like receiving portion of the mounting element.

In accordance with still another feature of the present invention, the holding portion may be constituted by a thin sheet plate which has a first part forming the holding portion, and a second part which is bent so that the receiving portion is formed as a hinge extending in the direction of elongation of the holding portion and located in the middle region of the latter. The holding portion may be manufactured from a thin steel sheet by a punching or stamping process, and it possesses both a small resistance to insertion into the support wall, and the rigidity required for driving the holding portion into aerated cement.

A further feature of the present invention is that a leading end section of the holding portion of the mounting element may be bevelled so as to form a leading tip. This tip may be formed by two beveled provided at both sides of the centrally located receiving portion. The thus-formed tip facilitates driving of the holding portion of the mounting element into the support wall.

A still further feature of the present invention is that the eye-like receiving portion of the mounting element may have an end face which is offset relative to an end edge of the plate-like holding portion by a distance which is equal to the thickness of the wire anchoring member. A support wall which is composed of aerated cement blocks has, as a rule, a small number of joint gaps. When the plate-like holding portion of the thus-constructed mounting element is driven into the support wall so that the end face of the former is flush with the outer face of the latter and the receiving portion is offset as mentioned above, the wire anchoring member which is hooked in the thus-offset receiving portion is also flush with the outer face of the support wall.

Finally, an additional feature of the present invention is that the plate-like holding portion may be provided with at least one convex section extending in the direction of elongation of the holding portion. Such a convex section improves the rigidity of the holding portion during its driving into the support wall. Two such convex sections may be provided at both sides of the centrally located receiving portion.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a view showing a cladding structure which is connected to a support wall by a wire anchoring member and a mounting element in accordance with the present invention; and FIG. 2 is a perspective view of the wire anchoring member and the mounting element.

DESCRIPTION OF THE PREFERRED EMBODIMENT

FIG. 1 depicts a cladding structure 2 which is located at a distance from a support wall 1 so as to provide for a ventilation. The cladding structure 2 is connected with the support wall 1 by wire anchoring members 3 which must take up loads acting mainly in pulling and compressing directions. For this purpose, one end portion 4 of the wire anchoring member 3 is bent off normal to its central portion and mortared in a joint of the cladding structure 2. As shown in FIG. 1, the wire anchoring members 3 lie on an upper layer of blocks of the cladding structure. A next following layer of blocks which is located above this upper layer and forms the joint with the latter is not shown for the sake of clarity. The wire anchoring member 3 has another end portion 5 which is normal to the central portion and offset relative to the end portion 4 by 90°.

A mounting element is provided for connecting the other end 5 of the wire anchoring member 3 to the support structure 1. The mounting element has a holding portion 7 and a receiving portion 6. The holding portion 7 is plate-like, whereas the receiving portion 6 is eye-like. The latter is located centrally of the holding portion 7 and extends in the direction of elongation of the same. The holding portion 7 is driven into a joints-forming face 8 of the support wall 1 by movement in the direction of elongation of this portion, so as to assume a position in which the holding portion 7 is parallel to the cladding structure 2. Then the end portion 5 of the wire anchoring member 3 is hooked into the eye-like receiving portion 6 of the mounting element. Since the holding portion 7 is plate-like, it takes up in its inserted position very high pulling and compression forces which are transmitted from the cladding structure 2 to the support wall 1 through the wire anchoring members 3. As a result of the hooking of the end portion 5 of the wire anchoring member 3 in the receiving portion 6 of the mounting element, a connection is provided between the above-mentioned parts which takes up these forces.

In order to attain a small resistance to insertion of the holding portion 7, on the one hand, and provide a sufficient rigidity for driving this portion into the support wall, the holding portion 7 is manufactured from a thin steel sheet. The eye-like receiving portion 6 is formed by bending of the sheet so as to form a sleeve-shaped hinge which extends lengthwise and centrally of the holding portion 6.

In order to further reduce the resistance to insertion of the holding portion 7 into the support wall 1, a leading end section of the holding portion 7 is bevelled at both sides of the receiving portion 6. Thereby, an insertion tip 9 is formed at a leading end of the holding portion 7, the tip having a width which decreases in the direction toward the leading end.

The holding portion 7 further has two convex sections extending in the direction of elongation of the former. The convex sections are formed at both sides of the receiving portion 6 and preferably are symmetrical. The thus-formed convex sections further increase the rigidity of the holding portion 7 during its driving into the support structure 1.

An end face 10 of the eye-like receiving portion 6 of the mounting element is offset relative to an end edge 11 of the plate-like holding portion 7 by a distance which is substantially equal to the thickness of the wire anchoring member 3. Thereby, when the plate-like holding portion 7 is driven into the support structure 1 so that the end edge 11 of the former is flush with the joints-forming outer face 8 of the latter, and the end portion 5 of the wire anchoring member 3 is hooked in the eye-like receiving portion 6 of the mounting element, the wire anchoring member 3 is also flush with the outer face 8 of the support structure 1. As a result of this, the outer face of the support structure remains flat and smooth.

It will be understood that each of the elements described above, or two or more together, may also find a useful application in other types of constructions differing from the types described above.

While the invention has been illustrated and described as embodied in a mounting element for connecting a cladding to a support structure, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A mounting element for connecting a ventilated cladding structure to a support wall, particularly one composed of aerated cement blocks, with the use of a wire anchoring member having one end mortared in a joint of the cladding structure, the mounting element comprising an eye-like receiving portion arranged to receive another end of the wire anchoring member, and a plate-like holding portion arranged to be driven into the supported wall retained in the latter and connected with said eye-like receiving portion so as to connect the support wall through said eye-like receiving portion and said anchoring member, with the cladding structure.

2. A mounting element as defined in claim 1, wherein said holding portion is constituted by a part of a sheet plate whose another part is bent so as to form a hinge forming said receiving portion.

3. A mounting element as defined in claim 2, wherein said holding portion is elongated in the direction of driving-in, said hinge which forms said receiving portion being also elongated and extending in the direction of elongation of said holding portion.

4. A mounting element as defined in claim 3, wherein said hinge which forms said receiving portion is located centrally of said holding portion as considered in a direction which is transverse to the direction of elongation of the latter.

5. A mounting element as defined in claim 1, wherein said holding portion has an end edge, said receiving portion having an end face which faces toward said end edge and is offset relative to the latter.

6. A mounting element as defined in claim 5, wherein the wire anchoring member has a predetermined thickness, said end face of said receiving portion being offset relative to said end edge of said holding portion by a distance corresponding to the thickness of the wire anchoring member.

7. A mounting element for connecting a ventilated cladding structure to a support wall, particularly one composed of aerated cement blocks, with the use of a wire anchoring member having one end mortared in a joint of the cladding structure, the mounting element comprising a plate-like holding portion arranged to be driven into an outer face of the support wall, said holding portion having an end section which is leading as considered in the direction of driving of said holding portion into the support wall, and is bevelled so as to form a tip; and an eye-like receiving portion arranged to receive another end of the wire anchoring member.

8. A mounting element as defined in claim 7, wherein said receiving portion is located centrally of said holding portion as considered in a direction which is transverse to said driving direction, said holding portion having two bevels which are formed at both sides of said receiving portion.

9. A mounting element for connecting a ventilated cladding structure to a support wall, particularly one composed of aerated cement blocks, with the use of a wire anchoring member having one end mortared in a joint of the cladding structure, the mounting element comprising a plate-like holding portion arranged to be driven into an outer face of the support wall, said holding portion being elongated in the direction of driving-in and having at least one convex section extending in the direction of elongation; and an eye-like receiving portion arranged to receive another end of the wire anchoring member.

10. A mounting element as defined in claim 9, wherein said receiving portion is located centrally of said holding portion as considered in a direction transverse to the direction of elongation, said holding portion further having a second such convex section, said convex sections being located at both sides of said receiving portion.

11. A method of connecting a ventilated cladding structure to a support wall, particularly composed of aerated cement blocks, comprising the steps of providing a wire anchoring member having two spaced ends; mortaring one of the ends of the wire anchoring member in a joint of the cladding structure; providing a mounting element having a plate-like holding portion and an eye-like receiving portion; driving the plate-like holding portion of the mounting element into the support wall, so that it is retained in the support wall; and hooking the other end of the wire anchoring member into the eye-like receiving portion of the mounting element, so that the plate-like holding portion of the mounting element connects the support wall through the eye-like receiving portion and the anchoring member, with the cladding structure.

* * * * *